US006357632B1

(12) United States Patent
Salmela

(10) Patent No.: US 6,357,632 B1
(45) Date of Patent: Mar. 19, 2002

(54) CONDIMENT DISPENSING APPARATUS

(75) Inventor: Juha Salmela, Citrus Heights, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 0 days.

(21) Appl. No.: 09/405,948

(22) Filed: Sep. 27, 1999

Related U.S. Application Data

(60) Provisional application No. 60/103,754, filed on Oct. 9, 1998.

(51) Int. Cl.[7] ..... B65D 88/54

(52) U.S. Cl. ..... 222/334; 222/504; 222/559

(58) Field of Search ..... 222/504, 334, 222/559, 144.5

(56) References Cited

U.S. PATENT DOCUMENTS 4,478,355 A * 10/1984 Houman ..... 222/504
4,911,333 A * 3/1990 Wilson ..... 222/153
5,360,027 A * 11/1994 Harman ..... 134/102.3
5,366,117 A * 11/1994 Mesenbring et al. ..... 333/334
5,428,959 A * 7/1995 Figiel et al. ..... 91/189 R
5,429,681 A * 7/1995 Mesenbring ..... 222/132
5,437,335 A * 8/1995 Hines, Sr. ..... 172/22
5,603,435 A * 2/1997 Fenwick ..... 222/240

* cited by examiner

*Primary Examiner*—David A. Scherbel
*Assistant Examiner*—Christopher S. Kim
(74) *Attorney, Agent, or Firm*—Townsend and Townsend and Crew LLP

(57) ABSTRACT

This invention provides a condiment dispensing apparatus of economically and effectively dispensing condiment by controlling condiment pump activation and opening and closing of the dispensing outlet without requiring electronic circuitry. The apparatus employs pneumatic devices to open and close the dispensing outlet and to drive the condiment pump and a mechanical mechanism to synchronize pump activation and opening and closing of the dispensing outlet. In a specific embodiment, a pneumatically driven valve is coupled to the pump for activating the pump after it is moved to at least partly open the dispensing outlet during a valve opening step and for deactivating the pump after it is moved to partly close the dispensing outlet during a valve closure step. The delay in pump activation during the valve opening step and the lead in pump deactivation during the valve closure step avoid excessive pressure buildup to ensure smooth operation of the apparatus in dispensing the condiment in a controlled manner.

20 Claims, 2 Drawing Sheets

CONDIMENT DISPENSING APPARATUS

This application is based on and claims priority from U.S. Provisional Application, Ser. No. 60/103,754, filed on Oct. 9, 1998, the entire disclosure of which is incorporated herein by reference.

BACKGROUND OF THE INVENTION

This invention relates generally to dispensing apparatus and, more particularly to an apparatus for dispensing condiments or the like. Condiment dispensing systems are commonly used in homes, offices, and restaurants. Effective operation of a condiment dispensing system requires the coordinated pumping of the condiment and the opening and closing of a dispensing outlet. Further, residual condiment can form at the dispensing outlet, and tends to dry and block the head. Heretofore, complex and expensive electronic circuitry was needed to synchronize condiment pumping and dispensing outlet opening and closure to control condiment flow and to minimize blockage by residual condiment formation. Thus, there is a need for a simplified, efficient, and inexpensive way of controlling condiment flow.

SUMMARY OF THE INVENTION

The present invention relates to a condiment dispensing apparatus for economically controlling condiment flow by synchronizing condiment pumping and dispensing outlet opening and closure without the need for electronic circuitry. The invention provides for dispensing condiment smoothly and effectively by utilizing pneumatics and mechanical mechanisms for controlling and synchronizing condiment pumping and dispensing outlet opening and closure. Shear mating surfaces are used at the dispensing outlet to shear off condiment flow during closure of the dispensing outlet to minimize or prevent residual condiment formation and associated blockage.

In accordance with an aspect of the invention, an apparatus for dispensing condiment comprises a dispensing head having a cavity, an inlet, and an outlet. A pump is provided for pumping condiment to the cavity through the inlet of the dispensing head. A stem is movable to close the outlet of the dispensing head in a closed position and to open the outlet in an open position. The stem is coupled to the pump for activating the pump after the stem is moved at least partly from the closed position to the open position and deactivating the pump after the stem is moved partly from the open position to the closed position.

In accordance with another aspect of the invention, an apparatus for dispensing condiment comprises a valve having a valve outlet and a valve stem movable between a closed position to close the valve outlet and an open position to open the valve outlet. A pump is provided for delivering condiment to the valve. The apparatus further includes mechanical means, coupled between the pump and the valve stem, for activating the pump to deliver the condiment to the valve after the valve stem is moved at least partly from the closed position to the open position and for deactivating the pump after the valve stem is moved partly from the open position to the closed position.

It is a particular object of the present invention to provide an improved system for economically and effectively dispensing condiment or the like without the need for electronic circuitry. Other objects and advantages of the present invention will be apparent from the following detailed description read in view of the accompanying drawings which are made a part of this specification.

BRIEF DESCRIPTION OF THE DRAWINGS

The specific embodiments of this invention, illustrating all their features, will now be discussed in detail. These embodiments depict the novel and nonobvious dispensing apparatus of this invention shown in the accompanying drawings, which are included for illustrative purposes only. These drawings include the following figures, with like numerals indicating like parts.

DESCRIPTION OF THE SPECIFIC EMBODIMENTS

Figure 1:
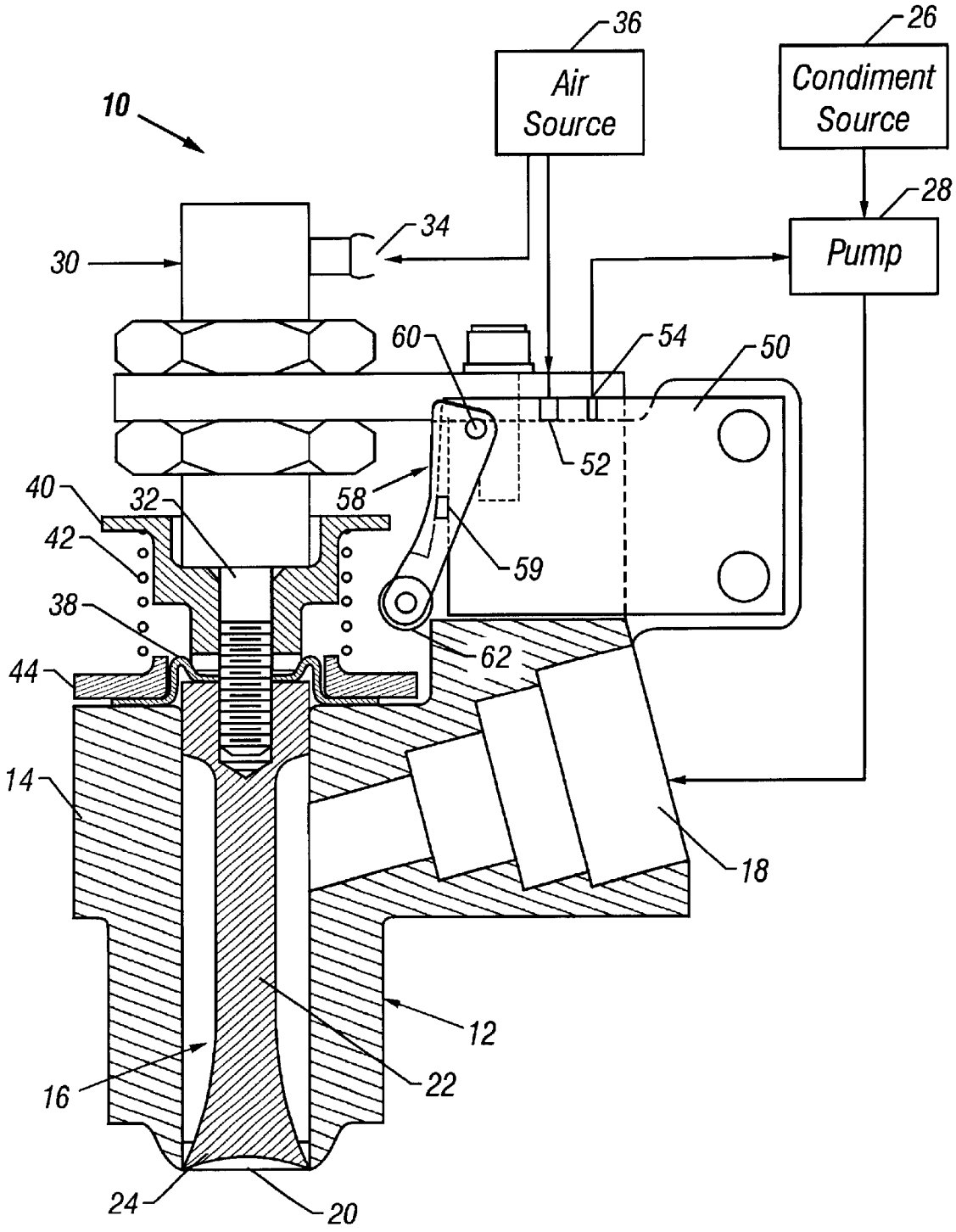
FIG. 1 is a partial cross-sectional view of a condiment dispensing apparatus in a closed position in accordance with an embodiment of the present invention.

Referring to the dispensing apparatus 10 of FIG. 1, a dispensing head or valve 12 has a valve body 14 with a valve cavity 16, a valve inlet 18, and a valve outlet 20. A valve stem 22 is disposed at least partially in the cavity 16 and includes a valve stem head 24 that cooperates with the valve outlet 20 to form a valve closure in the closed position shown in FIG. 1. The stem 22 is movable in the cavity 16 between the closed position of FIG. 1 and an open position shown in FIG. 2 which permits condiment flow out of the valve outlet 20. The valve inlet 18 is coupled to a condiment source 26 which supplies condiment to the cavity 16 for dispensing through the outlet 20. In the embodiment shown, a pump 28 is provided to pump the condiment from the source 26 to the valve cavity 16 through the inlet 18. The valve stem head 24 is configured to slidably mate with the valve outlet 20 to shear off condiment flow from the valve cavity 16 during valve closure to minimize residual condiment formation and associated blockage. As discussed below, the operation of the valve stem 22 and the pump 28 are coordinated to smoothly and effectively dispense condiment.

As shown in FIG. 1, the valve stem 22 is driven by a drive device. In this embodiment, a pneumatic drive device 30 such as an air cylinder or the like is used. The air cylinder 30 includes a drive shaft 32 coupled to the valve stem 22 and an air inlet 34 receiving air from an air source 36 for pneumatically controlling the movement of the drive shaft 32. When the air pressure builds up in the air cylinder 30 to push the drive shaft 32, it moves the stem 22 from the closed position of FIG. 1 to the open position of FIG. 2. A resilient seal 38 is desirably provided at the connection between the drive shaft 32 and the stem 22 to prevent leakage of air and condiment out of the cavity 16.

To allow the stem 22 to return from the open position to the closed position, the air flow to the air cylinder 30 is deactivated. A return mechanism is used to reverse the movement of the stem 22. In the embodiment shown, a return spring retainer 40 is used to achieve the reverse movement of the stem 22. The return spring retainer 40 is coupled to the drive shaft 32 and is supported by a spring 42 mounted to a stationary base 44 to bias the drive shaft 32 to move the stem to the closed position. In this embodiment, the base 44 is fixed relative to the valve body 14, and may be formed as part of the valve body 14 in a specific embodiment. The spring 42 exerts a biasing force through the retainer 40 to the drive shaft 32 to close the valve stem 22 when the air flow to the air cylinder 30 is deactivated. During activation of the air cylinder, the input air builds up sufficient pressure to overcome the biasing force of the spring 42 to open the valve stem 22. The valve stem 22, drive shaft 32, and retainer 40 move together during activation and deactivation of the air cylinder 30. In a specific embodiment, these components may be integrally formed as a single unit.

Figure 2:
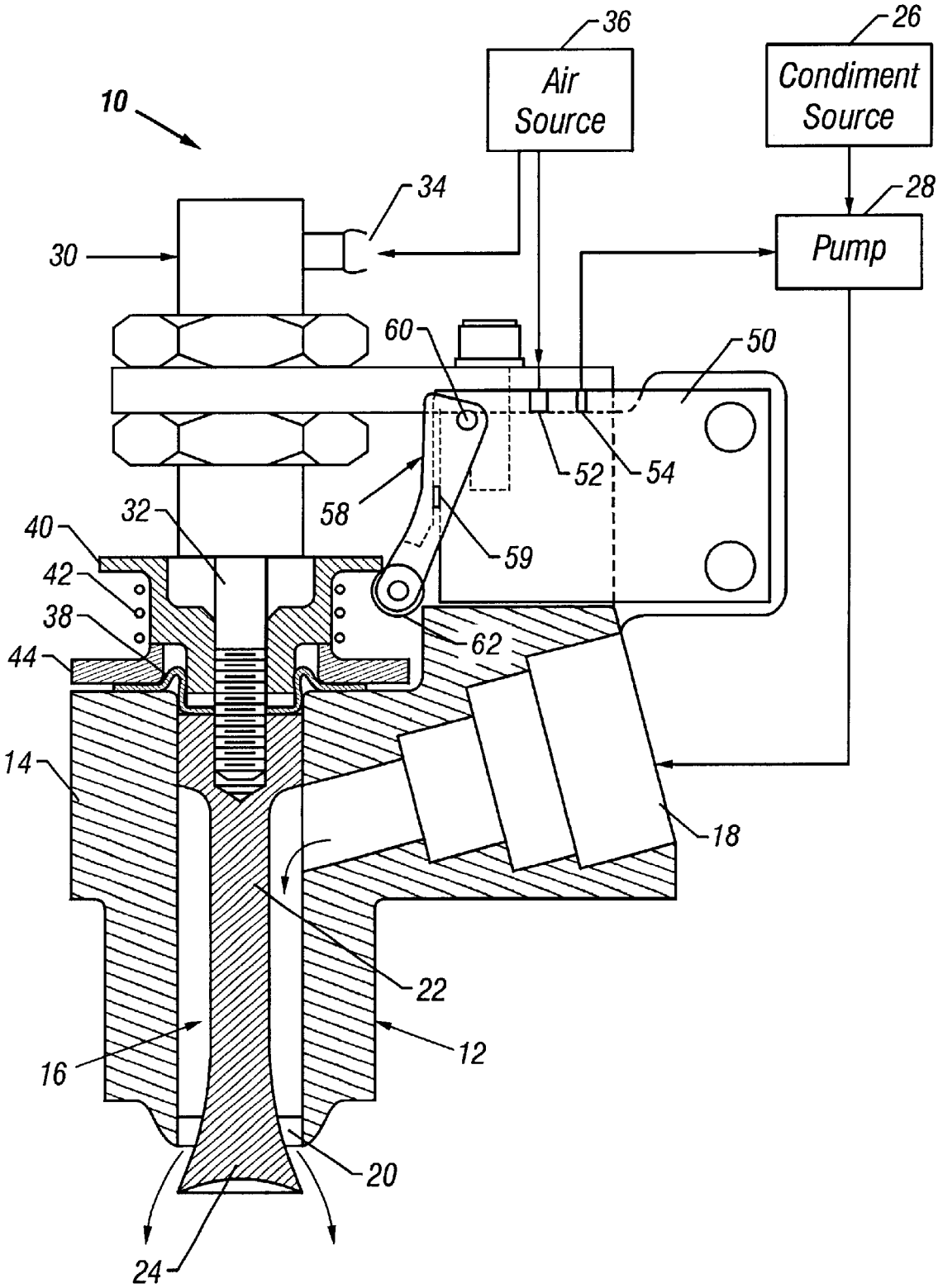
FIG. 2 is a partial cross-sectional view of the condiment dispensing apparatus of FIG. 1 in an open position.

To coordinate the movement of the stem 22 and the pumping of the condiment, a pump activation valve 50 is provided. In this embodiment, the pump activation valve 50 is also pneumatic in nature. The pump activation valve 50 has an air inlet 52 and an air outlet 54. The air inlet 52 is coupled to an air source, which may be the same air source 36 that supplies air to the air cylinder 30 or a separate source (not shown). The air outlet 54 is coupled to the condiment pump 28 for driving the pump 28 to pump condiment from the condiment source 26 to the dispensing valve 12. The pump activation valve 50 activates the pump 28 when air is directed from the air source 36 to the pump 28 to drive the pump and deactivates the pump when the air flow is halted. The air flow is controlled by an activation member 58 which is displaceable to open and shut air flow from the air source 36 through the activation valve 50 to the pump 28. The present embodiment employs an activation lever arm 58 which is pivotable to push a knob 59 to operate a gate (not shown) for opening and shutting off air flow from the air source 36 through the air inlet 52 to the pump activation valve 50. The lever arm 58 is rotatably anchored at a pivot point 60 to pivot relative thereto when contacted by the return spring retainer 40, as best seen in FIG. 2. When the retainer 40 is moved downward to open the valve stem 22, it contacts the lever arm 58 and pivots it in a counterclockwise direction to open the air flow through the pump activation valve 50 to activate the pump 28 in an activation position (FIG. 2). The lever arm 58 desirably includes a roller 62 for making rolling contact with the retainer 40 to minimize friction or drag. When the spring 42 biases the retainer 40 to return the stem 22 to the closed position (FIG. 1), the retainer 40 is disengaged from the lever arm 58. The lever arm 58 is desirably biased to rotate in the clockwise direction and return to a deactivation position (FIG. 1) when the retainer 40 is disengaged. For instance the lever arm 58 or the air flow gate (not shown) can be spring-loaded to return to the deactivation position in a manner similar to the operation of the spring-biased retainer 40.

The apparatus 10 preferably provides a more refined synchronization of motion between the movement of the valve stem 22 and the activation of the pump 28. As shown in FIGS. 1 and 2, the retainer 40 makes contact with the lever arm 58 to activate the pump 28 only after the retainer 40 has traveled a certain distance to partially open the valve stem 22 at the valve outlet 20. In the embodiment shown, the components are configured to activate the pump 28 during the valve opening step (from FIG. 1 to FIG. 2) after the valve stem 22 has moved at least about half-way of its travel range from the closed position to the open position. In a specific embodiment, the pump 28 is activated after the stem 22 has moved about two-third-way from the closed position to the open position. During the valve closure step (from FIG. 2 to FIG. 1), the pump 28 is deactivated after the valve stem 22 has moved less than about half-way from the open position to the closed position. In a specific embodiment, the pump 28 is deactivated after the stem 22 has moved about one-third-way from the open position to the closed position. The delay in pump activation during the valve opening step and the lead in pump deactivation during the valve closure step avoid excessive pressure buildup in the valve cavity 16 during activation and deactivation. This ensures smooth operation of the dispensing apparatus 10 in dispensing the condiment in a controlled manner.

The principles, preferred embodiments and modes of operation of the present invention have been described in the foregoing specification. However, the invention which is intended to be protected is not to be construed as limited to the particular embodiments disclosed. The embodiments are to be construed as illustrative rather than restrictive. Variations and changes may be made by others without departing from the spirit of the present invention. For instance, the apparatus of the present invention may be used for dispensing other products, including perishables with milk and egg products such as ice cream products. Accordingly, all such variations and changes which fall within the spirit and scope of the present invention as defined in the following claims are expressly intended to be embraced thereby.

What is claimed is:

1. An apparatus for dispensing a fluid comprising:

a dispensing head having a cavity, an inlet, and an outlet;

a pump for pumping a fluid to the cavity through the inlet of the dispensing head;

an outwardly opting valve including a stem movable to close the outlet of the dispensing head in a closed position and to open the outlet in an open position, wherein the stem has a stem head protruding from the outlet in the open position and shaped to slidably mate with the outlet of the dispensing head to shear off the fluid flow from the cavity of the dispensing head when the stem is moved to the closed position; and a pump activation member coupled to the pump and movable by the stem to an activation position to activate the pump after the stem is moved at least partly from the closed position to the open position and to a deactivation position to deactivate the pump after the stem is moved partly from the open position to the closed position.

2. The apparatus of claim 1 wherein the stem is disposed at least partially in the cavity of the dispensing head and movable therein.

3. The apparatus of claim 1 wherein the stem is pneumatically driven to move between the open position and the closed position.

4. The apparatus of claim 3 further comprising an air cylinder coupled to the stem for pneumatically driving the stem to move from the closed position to the open position.

5. The apparatus of claim 1 wherein the stem is resiliently biased to move from the open position to the closed position.

6. The apparatus of claim 5 further comprising a return spring coupled to the stem for resiliently biasing the stem to move from the open position to the closed position.

7. The apparatus of claim 1 wherein the pump activation member comprises an arm movement of the stem to pneumatically activate the pump.

8. The apparatus of claim 7 wherein the pump activation member comprises a roller for making rolling contact with the stem during movement of the stem.

9. The apparatus of claim 1 wherein the stem is coupled to the pump for activating the pump after the stem is moved at least about half-way from the closed position to the open position.

10. The apparatus of claim 9 wherein the stem is coupled to the pump for activating the pump after the stem is moved about two-third-way from the closed position to the open position.

11. The apparatus of claim 1 wherein the stem is coupled to the pump for deactivating the pump after the stem is moved less than about half-way from the open position to the closed position.

12. The apparatus of claim 11 wherein the stem is coupled to the pump for deactivating the pump after the stem is moved about one-third-way from the open position to the closed position.

13. The apparatus of claim 1 wherein the stem has a stem head shaped to slidably mate with the outlet of the dispensing head to shear off the fluid flow from the cavity of the dispensing head when the stem is moved to the closed position.

14. An apparatus for dispensing condiment comprising:

an outwardly opening valve having a valve outlet and a valve stem movable between a closed position to close the valve outlet and an open position to open the valve outlet;

a pump for delivering condiment to the valve; and a pump activation member, coupled to the pump and movable by the valve stem, to an activation position for activating the pump to deliver the condiment to the valve after the valve stem is moved at least partly from the closed position to the open position and to a deactivation position for deactivating the pump after the valve stem is moved partly from the open position to the closed position, wherein the valve stem has a portion which protrudes from the valve outlet in the open position and which slidably cooperates with the valve outlet to shear off condiment flow form the valve through the valve outlet when the valve stem is moved to the closed position.

15. The apparatus of claim 14 further comprising pneumatic means for pneumatically driving the valve stem from the closed position to the open position.

16. The apparatus of claim 14 further comprising resilient means for resiliently biasing the valve stem to move from the open position to the closed position.

17. The apparatus of claim 14 wherein the pump is pneumatically controllable.

18. The apparatus of claim 14 wherein the valve stem is coupled to the pump for activating the pump after the stem is moved at least about half-way from the closed position to the open position.

19. The apparatus of claim 14 wherein the valve stem is coupled to the pump for deactivating the pump after the stem is moved less than about half-way from the open position to the closed position.

20. The apparatus of claim 14 wherein the pump activation member comprises an arm pivotable by movement of the valve stem to pneumatically activate the pump.

* * * * *